US008374878B2

(12) United States Patent
Miller et al.

(10) Patent No.: US 8,374,878 B2
(45) Date of Patent: Feb. 12, 2013

(54) AUDIO ENVELOPES

(75) Inventors: Carol Miller, Twinsburg, OH (US); Mary McClain, Shaker Heights, OH (US); David Mayer, Bay Village, OH (US); Sharon Bogdanski, North Olmstead, OH (US); Kimberly Bikowski, Avon, OH (US); Theresa Muri, Richfield, OH (US); Julie Vojtko, Stow, OH (US)

(73) Assignee: American Greetings Corporation, Cleveland, OH (US)

( * ) Notice: Subject to any disclaimer, the term of this patent is extended or adjusted under 35 U.S.C. 154(b) by 672 days.

(21) Appl. No.: 12/489,829

(22) Filed: Jun. 23, 2009

(65) Prior Publication Data

US 2009/0314668 A1 Dec. 24, 2009

Related U.S. Application Data

(60) Provisional application No. 61/132,828, filed on Jun. 23, 2008.

(51) Int. Cl.
*G10L 21/00* (2006.01)

(52) U.S. Cl. ..... 704/272; 704/270; 704/278; 434/319

(58) Field of Classification Search ..... 704/200–210, 704/272, 270, 278; 434/319; 229/82; 493/68; 383/93

See application file for complete search history.

(56) References Cited

U.S. PATENT DOCUMENTS

| | | | | |
|---|---|---|---|---|
| 892,675 | A | 7/1908 | Morrison | |
| 2,336,867 | A | 12/1943 | Huber | |
| 4,114,799 | A | 9/1978 | Brown | |
| 4,437,380 | A | 3/1984 | Yamaguchi | |
| 5,273,361 | A * | 12/1993 | Jillson | 383/93 |
| 5,387,108 | A | 2/1995 | Crowell | |
| 5,447,334 | A | 9/1995 | Hartsock | |
| 5,577,918 | A * | 11/1996 | Crowell | 434/319 |
| 6,036,806 | A | 3/2000 | Dahlquist | |
| 6,640,473 | B1 | 11/2003 | Shenk | |
| 6,725,587 | B2 | 4/2004 | Collins | |
| 7,108,650 | B2 | 9/2006 | Marzano | |
| 7,780,588 | B2 * | 8/2010 | Clegg | 493/68 |
| 7,857,196 | B1 * | 12/2010 | Gorman | 229/82 |
| 2009/0326955 | A1 * | 12/2009 | Vantieghem | 704/272 |

* cited by examiner

*Primary Examiner* — Huyen X. Vo

(74) *Attorney, Agent, or Firm* — James C. Scott; Roetzel & Andress

(57) ABSTRACT

Audio or sound envelopes contain or are combined with a sound module for generating and playing prerecorded sound tracks upon the opening of the envelope or removal of its contents. Operation of the sound module may be activated by the opening of the envelope flap, or by removal of the envelope contents. The flap is configured with a removable strip which protects the sound module from damage before and after opening. The sound module can be replayed by repeated operation of the flap. Alternate embodiments of the audio envelopes have other structural or operational features which work in concert with the sound module.

28 Claims, 10 Drawing Sheets

AUDIO ENVELOPES

RELATED APPLICATIONS

This application claims priority to Provisional U.S. Patent Application No. 61/132,828 filed on Jun. 23, 2008.

FIELD OF THE INVENTION

The present disclosure and related inventions relate to envelopes, and more specifically to sound-producing envelopes that are designed to generate sound when the user opens the envelope.

BACKGROUND OF THE INVENTION

Greeting card envelopes have typically been considered as strictly a protective packaging or storage device for a greeting card. Most greeting card envelopes are the standard 5¾ by 8¾ white envelope in which a greeting card may be inserted for delivery. Most advances in this area have involved the greeting card. Greeting cards have become more entertaining with advances in printing and with the advent of small portable data storage devices. Sound has been added to greeting cards to increase the personalization of cards by delivering an audio message that is electronically embodied in circuitry that is carried within the greeting card. The ability to use sound in combination with printed matter such as with conventional printed greeting cards significantly enhances the communicative value of social and relational greetings. The use of popular music and celebrity voice impersonations has made sound-generating greeting cards increasingly popular.

More recently, envelopes have started to be considered a decorative aspect of or complimentary to the envelope contents. Considering that envelopes very often do not contain a greeting card but perhaps a handwritten note or gift card, more thought has been given to the decorative or entertainment aspect of the envelope. Given that most envelopes are made of paper or paper-like material, they are intrinsically amendable to embellishment with text, graphics, size, shape, color, texture and design. The sound or audio envelope functions both as an envelope and as a sound-generating, entertainment or message-carrying device independent of or in connection with its contents.

SUMMARY OF THE INVENTION

Audio envelopes (alternatively referred to herein as "sound envelopes") take the entertainment value and personalization of the envelope to a new level. The envelopes have a sound-generating device or sound module inside the envelope and operatively connected to an openable flap of the envelope, so that when the envelope is opened via the flap, sound generated by the sound module is audible. In a representative embodiment, an envelope has a generally rectangular and planar configuration, and an openable flap along one side and which is attached to one of the panels of the envelope along a fold line. A sound module is mounted inside the envelope, preferably proximate to the fold line of the flap. As the flap is opened by a hinge action of the fold line, the sound module is activated to generate sound, such as for example by completion of a circuit by movement of the flap about the fold line hinge, by which the sound module is powered to operate. The invention in its various embodiments is applicable to any type of envelopes.

In accordance with other aspects of the disclosure, the envelope flap may be secured to a facing panel of the envelope by adhesive, such as temporary adhesive or permanent adhesive, at a location or in an area which is spaced from the fold line hinge and form the sound module. The envelope flap may be opened along the fold line by first detaching it from the facing panel, by for example breaking of an adhesive bond, cutting or tearing any area of the flap which is sufficiently spaced from the fold line and particularly from the sound module, and then pivoting the flap about the fold line.

In one embodiment, the envelope flap is openable by removal of a strip of material which extends through the flap and which generally bisects the flap. A pull tab is formed by an end of the removable strip. The removable strip can be formed integrally with the flap, and located, for example, between an area of the flap which is adhesively or otherwise secured to a facing panel, and the fold line hinge. Removal of the strip thus releases the remained of the flap to allow it to pivot about the fold line hinge to thereby give open access to the envelope and also activate the sound module. The location and operation of the removable strip protects the sound module from inadvertent damage to the sound module, which would otherwise occur if the envelope were opened in a conventional manner by slitting the fold line.

The sound module may be, for example, a battery-operated device of the types commercially available which include circuitry including audio signal generating integrated circuit chip, a digital memory storage device for storing pre-loaded digital audio data, a sound producing device in the form of a speaker, a battery power source, and a switch for opening and closing electrical contact with the battery connection to the circuitry. In one embodiment, the switch may be formed in part with a slide mechanism which translates laterally with respect to the circuitry via a mechanical connection to an interior surface of the envelope flap, as shown in the drawing figures and photographs. As the envelope flap is opened about the fold line hinge, the switch is translated to close the circuit, for example to complete the electrical connection between the batter power source and the sound generating circuitry. Conversely, closing the envelope flap interrupts connection to the battery power source and stops the sound generation by the sound generating circuitry.

DETAILED DESCRIPTION OF PREFERRED AND ALTERNATE EMBODIMENTS

Figure 1:
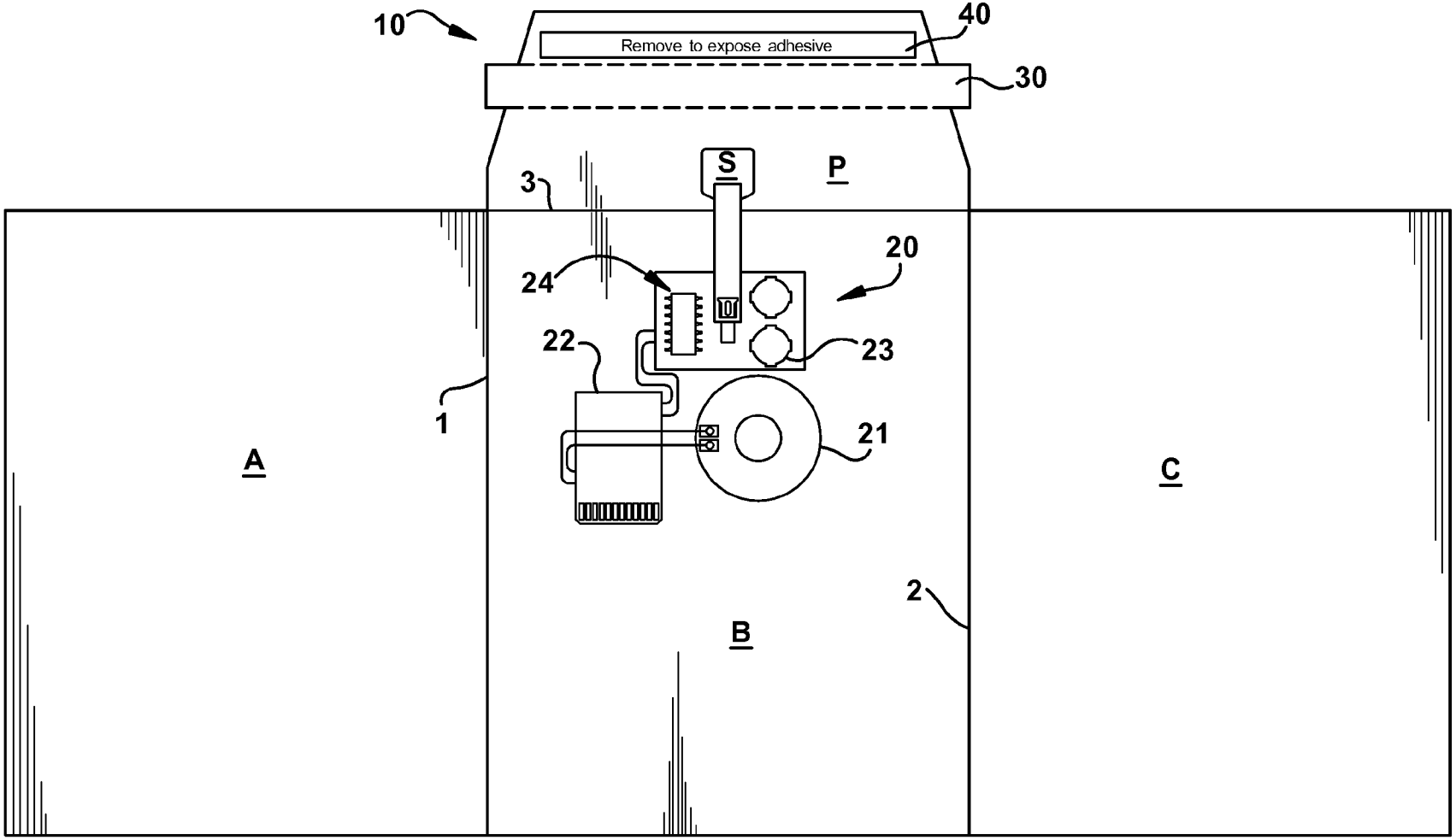
FIG. 1 is a drawing of the panels, flap and sound module of the sound envelope of the present invention prior to assembly.

A representative embodiment of an audio or sound envelope of the present disclosure can be constructed from suitable paper or card stock, such as a single die cut piece, which is folded to form the envelope body and the flap. The envelope construction can be executed in any particular size, shape or configuration. In a preferred embodiment, as shown in FIG. 1, the audio envelope can be constructed with three main panels A, B and C, connected respectively along fold lines 1 and 2. The envelope flap P is connected to an edge of panel B along the fold line hinge 3. All of the components of the sound module 20 can be mounted on panel B, for example, in a position proximate to the flap P and fold line hinge 3. A slide mechanism S of the sound module extends from the sound module 20 to the flap P, transversing the fold line hinge 3, and is secured to an interior surface of the flap P, for the described operation by pivot movement of the flap P about the fold line hinge 3. The sound module 20 shown contains the slide mechanism S, speaker 21, integrated circuit 22, a power source (batteries) 23 and a digital storage device 24. The entire sound module 20 is preferably concealed by panel A which is folded about fold line 1 to overlie panel B. Panel A is secured to panel B by adhesive at the panel edges or elsewhere.

Figure 2:
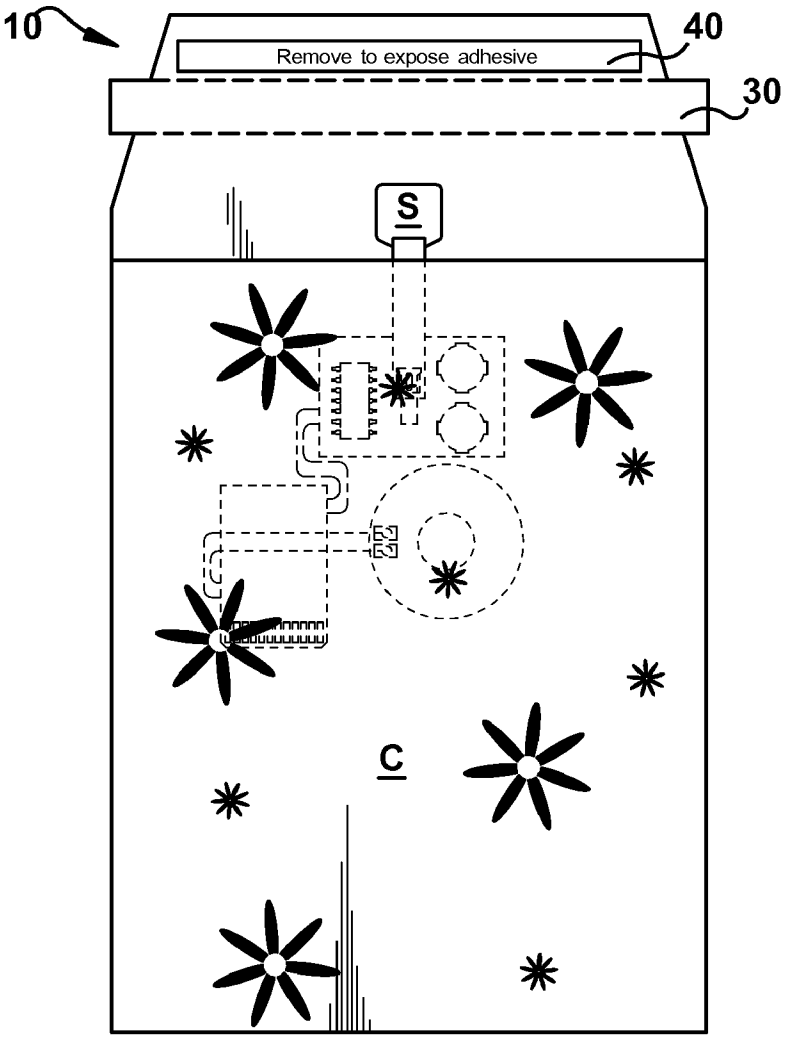
FIG. 2 is a drawing of the back side of the sound envelope of FIG. 1 after assembly and with an open flap.

As depicted in FIG. 2, with panel A secured to panel B, panel C is secured to an opposite side of panel A, for example by adhesive at a perimeter. A cavity is thus formed between panels C and A which forms the interior volume of the audio envelope, sufficient to receive a card or other generally planar or low profile articles. The sound module 20 is contained and concealed between panels A and B. The sound generated by the speaker 21 of the sound module 20 is easily audible, particularly through panel B with the speaker 21 preferably oriented to face toward the exterior side of panel B.

Figure 3:
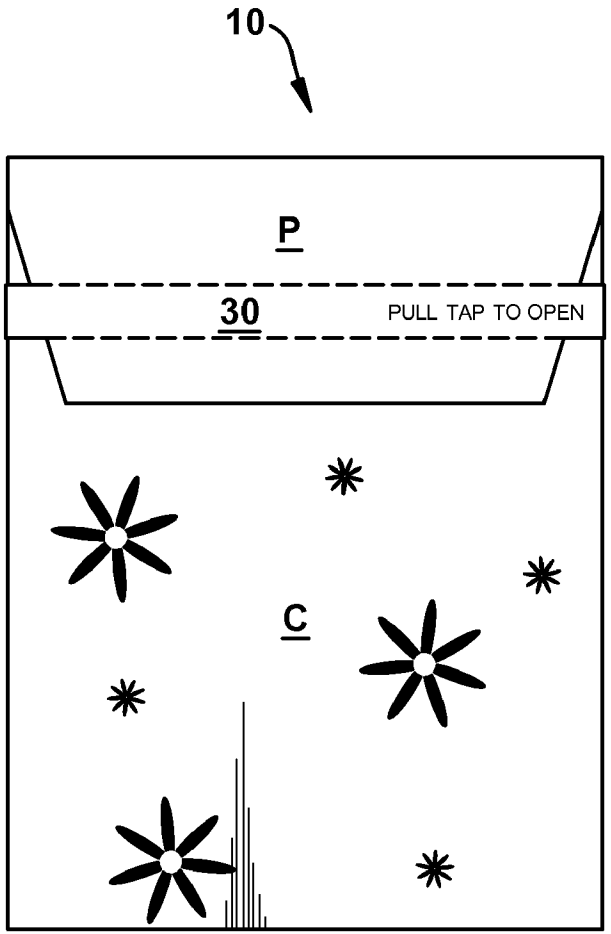
FIG. 3 is a drawing of the sound envelope of FIG. 2 with a closed flap.

In a preferred embodiment, the envelope closure mechanism is an adhesive strip 40, for example, in the form of covered adhesive, pressure, heat or moisture activated, provided on the interior side of flap P, proximate to an opening mechanism, which in a preferred embodiment, is in the form of a removable pull-tab 30. The removable pull-tab 30 is integral with the flap P along two perforated lines which allow for easy removal of the pull-tab 30. As shown, the removable pull-tab 30 is located between the slide mechanism S and the envelope closure mechanism or adhesive strip 40. It is also spaced apart from the area of attachment of the slide mechanism S toward the interior of the flap P to insure that the slide mechanism S is not damaged when the envelope flap P is opened via the removable pull-tab 30. The envelope opening mechanism, as shown, in a preferred embodiment, is a removable pull-tab 30, however, the envelope opening mechanism can be any suitable mechanism that is removable, breakable, or detachable from the envelope in a manner that will not harm the slide mechanism S. Alternatively, the sound envelope opening and closing mechanisms can be the same mechanism, such as a button, a snap, or any other suitable mechanism that is able to seal and open the envelope without damaging the slide mechanism S. FIG. 3 shows the backside of the audio envelope 10 with the flap P in a closed or scaled position. The audio envelope recipient must follow the instructions to pull the tab to open the envelope.

Figure 4:
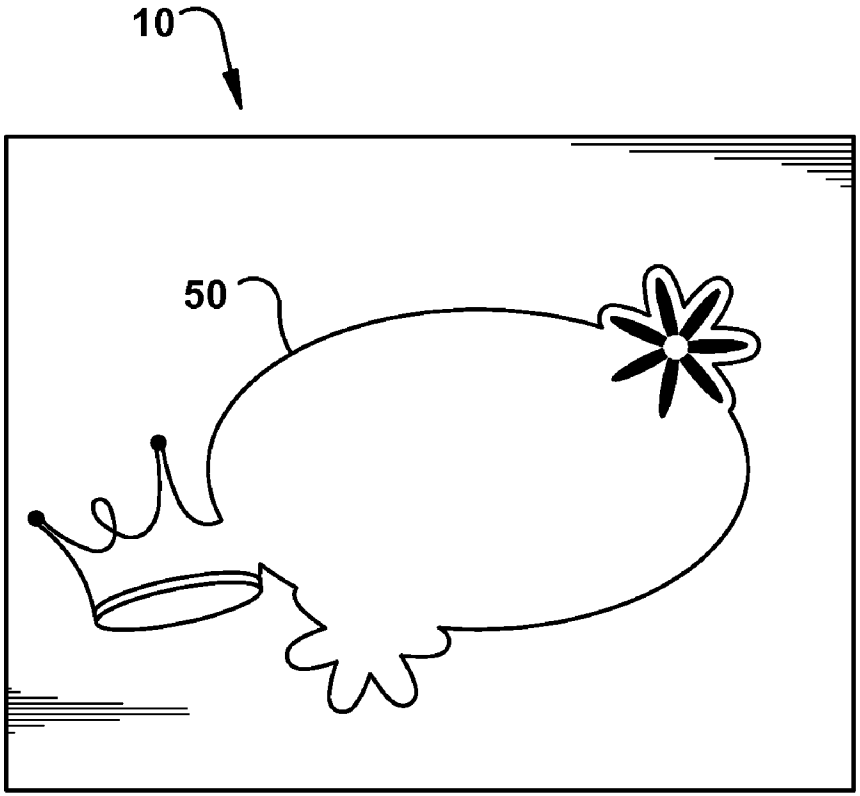
FIG. 4 is a drawing of the front side of the sound envelope of FIG. 2.

A representative front face of the envelope is depicted in FIG. 4. An address area 50 is set-off towards the center of the envelope and can be used as an area of the envelope to print the recipients address or to affix a name and address label thereto.

Figure 5:
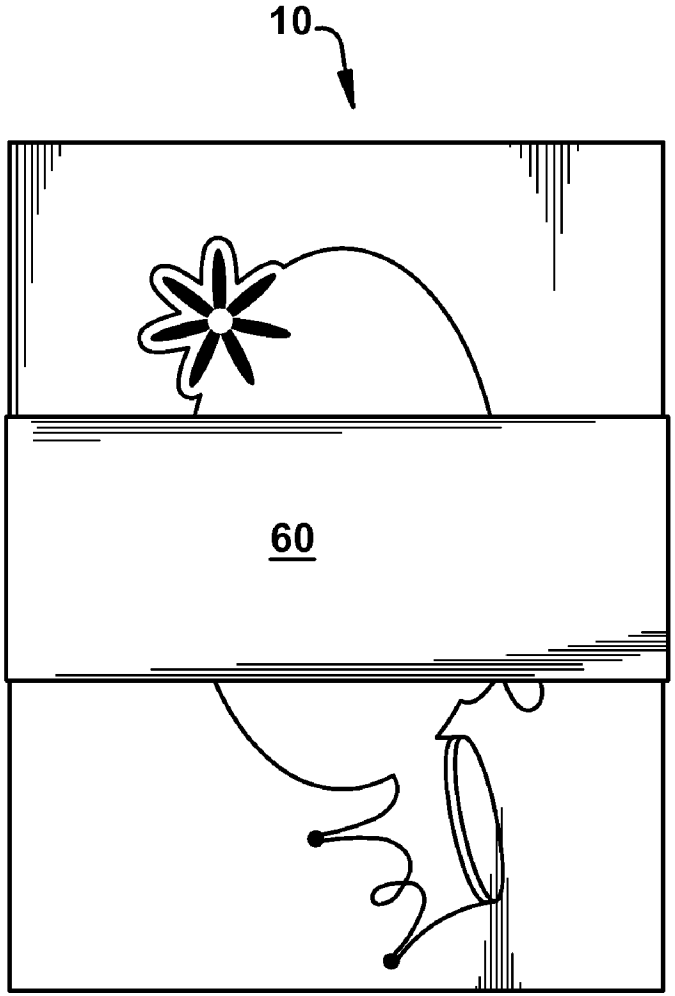
FIG. 5 is a drawing of a sound envelope packaged for individual sale.

Audio envelopes may be packaged and sold alone or in combination with a greeting card. When sold or displayed as a stand-alone item, the envelope may simply contain a paper retail band as shown in FIG. 5. The band, which can be of any size or shape, wraps around the body of the envelope where the ends of the band are affixed to each other using glue or any suitable adhesive. The band can be used to display bar coding, retail sale information and the like. The band is easily removed by simply sliding the band down to the bottom of the card or it can easily be torn apart and removed. Alternatively, the retail information may be contained on a removable sticker, a package header, or any other suitable retail packaging.

Figure 6B:
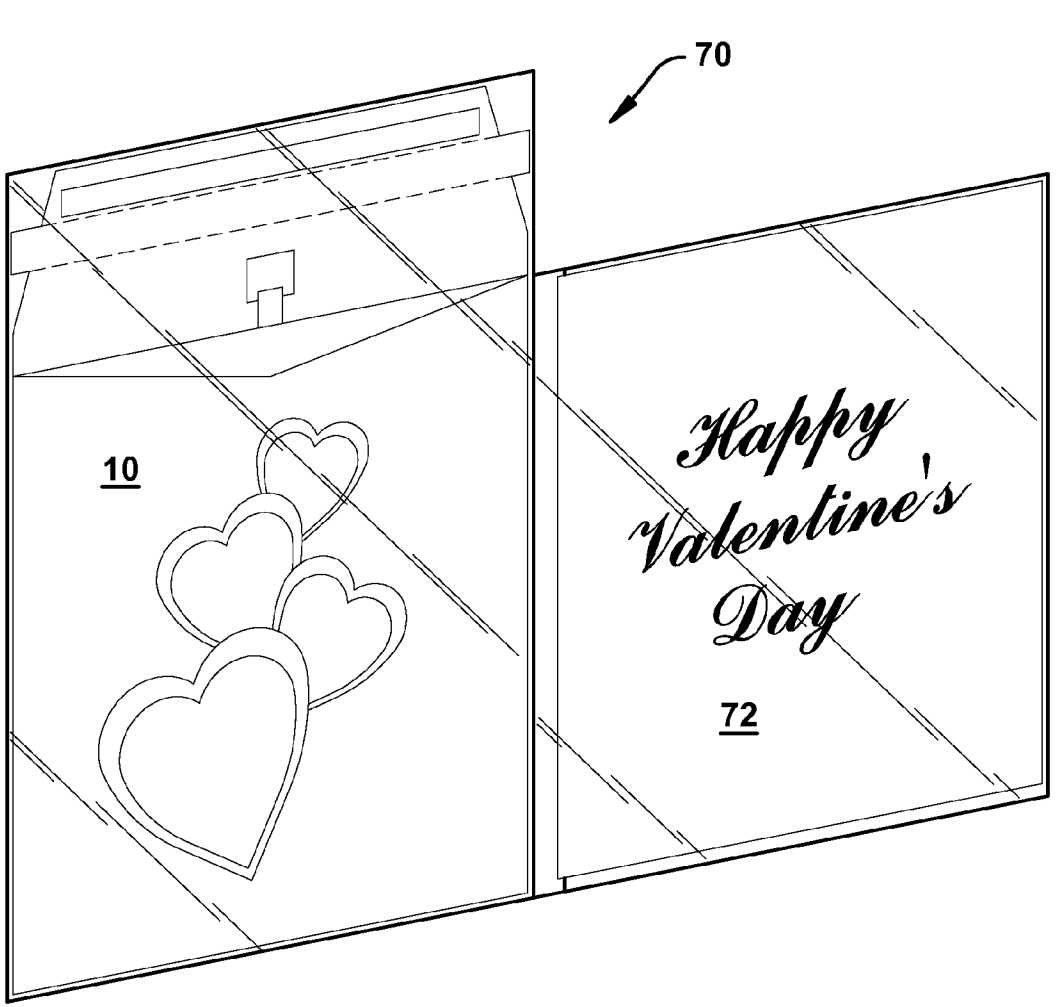
FIG. 6B is a drawing of the greeting card/sound envelope combination of FIG. 6A in an open position.
Figure 6A:
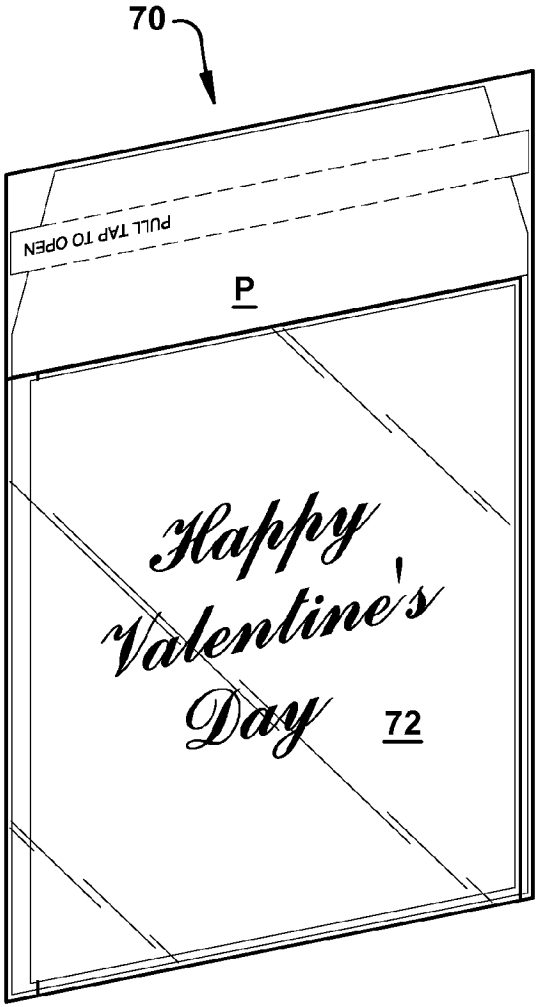
FIG. 6A is a front view of a greeting card/sound envelope combination packaged for sale in a protective sleeve.
Figure 6C:
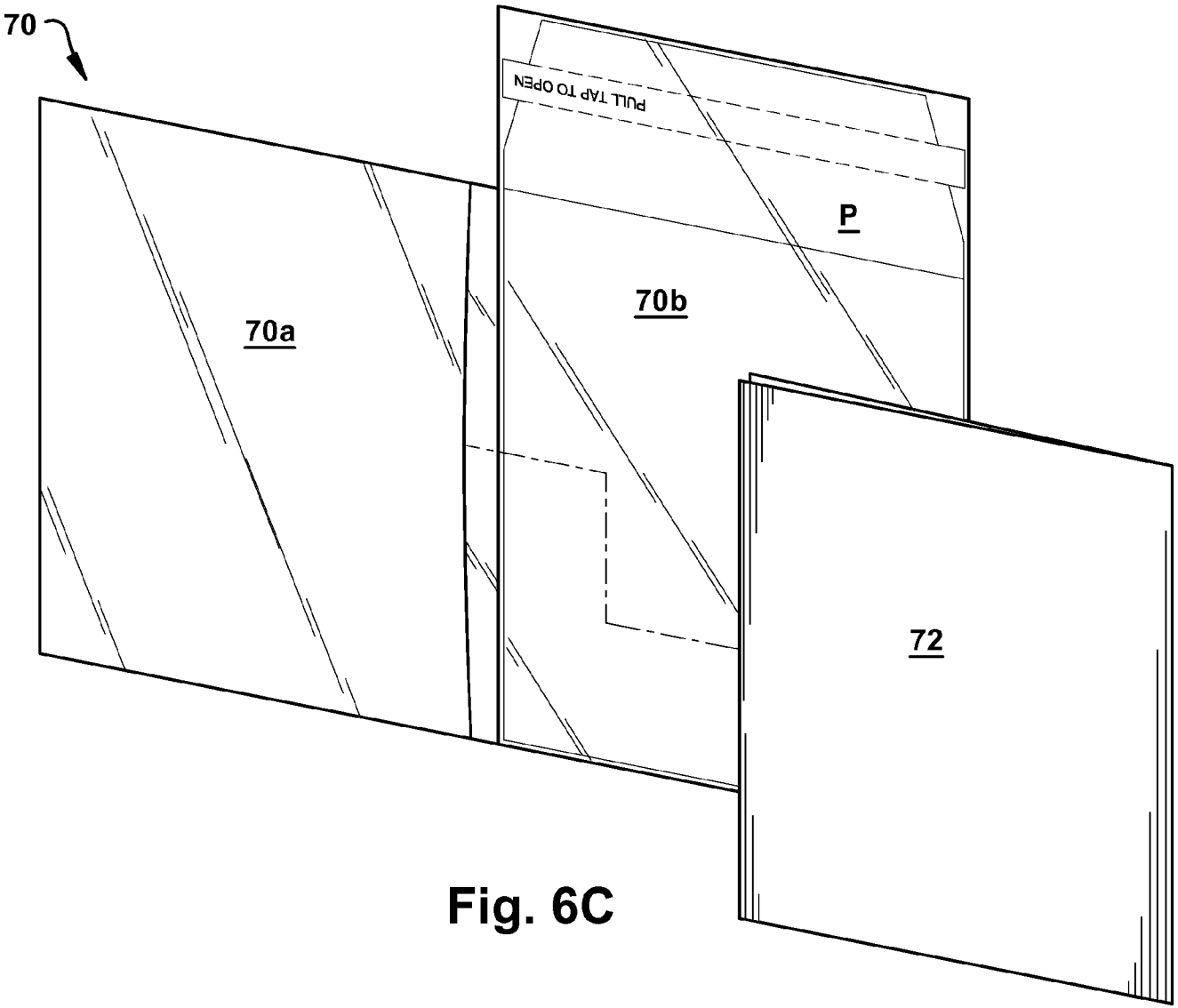
FIG. 6C is a drawing of the greeting card/sound envelope combination of FIG. 6A illustrating the position of the greeting card with respect to the envelope and the packaging.

As shown in FIGS. 6A-6C, when packaged together, the greeting card and audio envelope may be placed into a lightweight clear sleeve structure 70 that protects the greeting card 72 and envelope 10 while allowing the buyer to view both the outside and inside of the greeting card 72 and the envelope 10. The buyer may also preview the sound clip by lifting the flap P. The structure contains two separate sleeves—a first or left-side sleeve 70*a* and a second or right-side sleeve 70*b*. As shown, the first or left-side sleeve 70*a* is a rectangular shaped sheath containing an opening at the inside right edge for insertion of the front cover of a greeting card, as shown in FIG. 6C. The second or right-side sleeve 70*b* contains an opening at the bottom edge for insertion of the audio envelope. The envelope 10 is placed backwards into the second sleeve so that the backside or opening side of the envelope 10 is visible through the back of the second sleeve 70*b*, as shown in FIG. 6B. The top of the second sleeve 70*b* is folded downward along with the flap P of the audio envelope 10 and the bottom of the second sleeve 70*b* is folded upward and attached to the body of the sleeve using an appropriate, easily removable clear adhesive. The second panel of the greeting card 72 is therefore disposed between the first and second sleeves of the plastic structure. Also, the audio envelope 10 may be packaged alone, without a greeting card, for example, in a similar lightweight clear sleeve structure.

Figure 7:
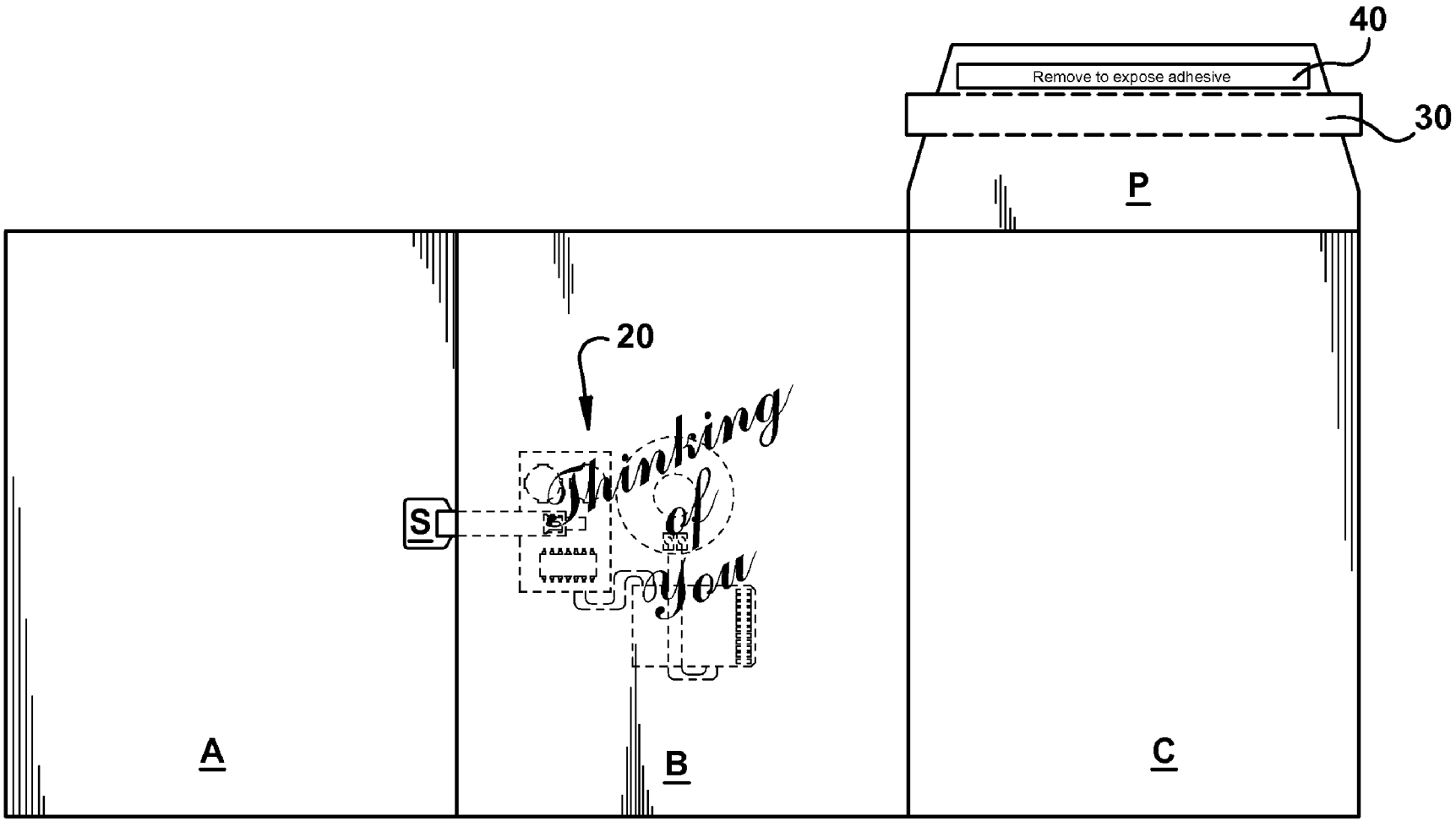
FIG. 7 is a second embodiment of the sound envelope of FIG. 1 having an integrated greeting card and envelope.
Figure 8:
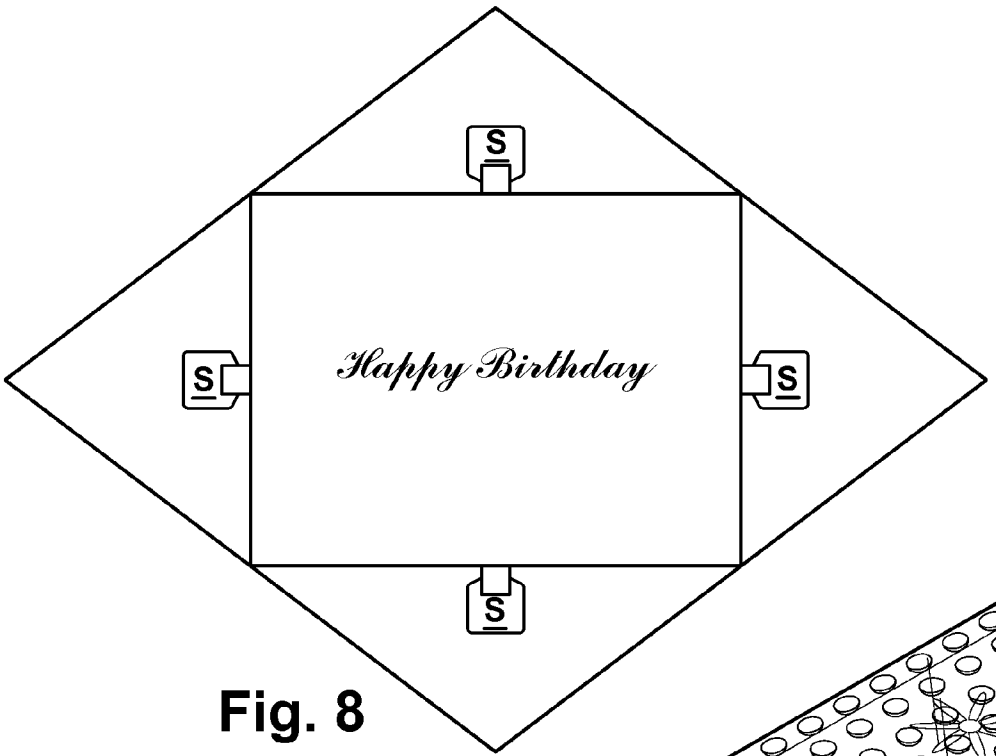
FIG. 8 is a third embodiment of the sound envelope of FIG. 1 having an integrated greeting card and envelope and more than one sound mechanism.

Second and third embodiments of the audio envelope are shown in FIGS. 7 and 8. Both embodiments are variations of an integrated greeting card envelope combination. The second embodiment, depicted in FIG. 7, preferably contains at least three panels, one of which is used to cover the sound module. The slide mechanism S is placed on a fold line between panels so that the sound clip will be triggered upon the movement of one panels about the hinge or fold line. One side of the panels constitutes the greeting card wherein text and/or graphics are printed and the opposite side constitutes the envelope wherein name and address lines are printed. Several tabs are located around one of the panels that may contain a removable adhesive strip or some other suitable attachment mechanism so that the greeting card/envelope may be sealed. The third embodiment, shown in FIG. 8, contains one main panel that is folded diagonally about each corner. Preferably, the sound module is hidden behind the first panel. There may be up to four different sound clips that are activated by slide mechanisms placed across each fold line. When each corner is folded inward, the edges may be secured by a seal or some other suitable attachment mechanism and the back of the structure may be addressed for delivery.

Figure 9:
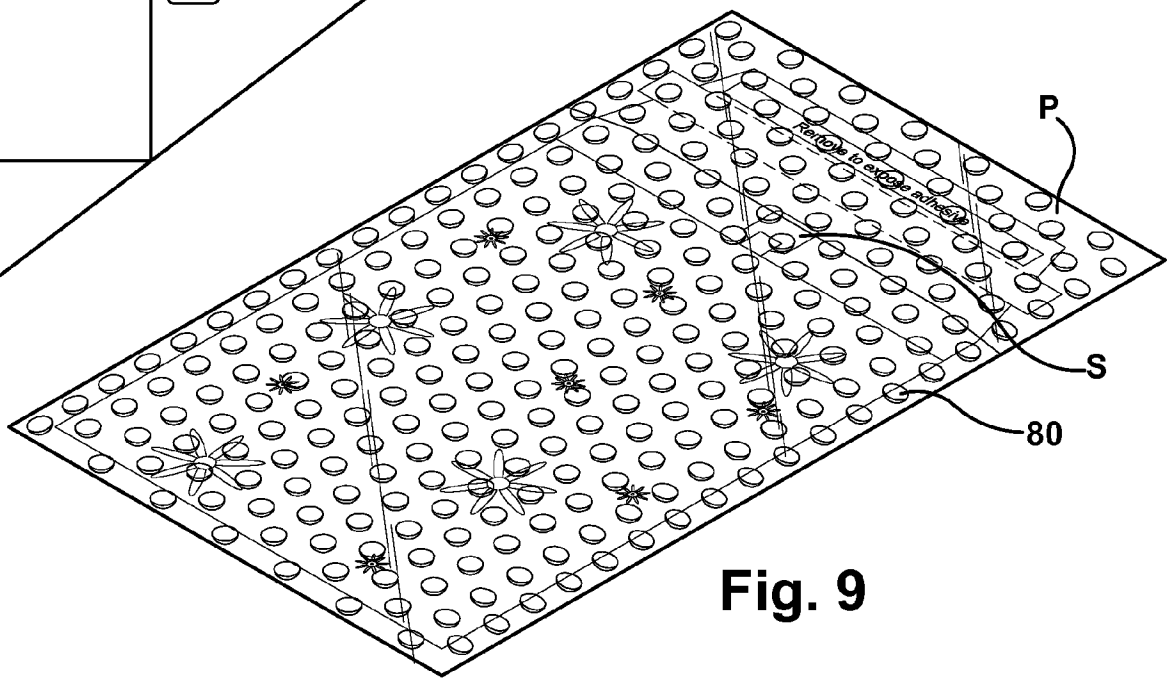
FIG. 9 is a fourth embodiment of the sound envelope of FIG. 1 wherein the envelope is lined in bubble wrap.

A fourth embodiment of the audio envelope is shown in FIG. 9. This embodiment is a bubble wrap audio envelope containing a sound module beneath the bubble liner of the envelope. A slide mechanism is placed along the fold line between the front panel of the envelope and the flap closure that activates the sound clip upon opening the flap along the hinge or fold line across which the slide mechanism is placed.

Figure 10:
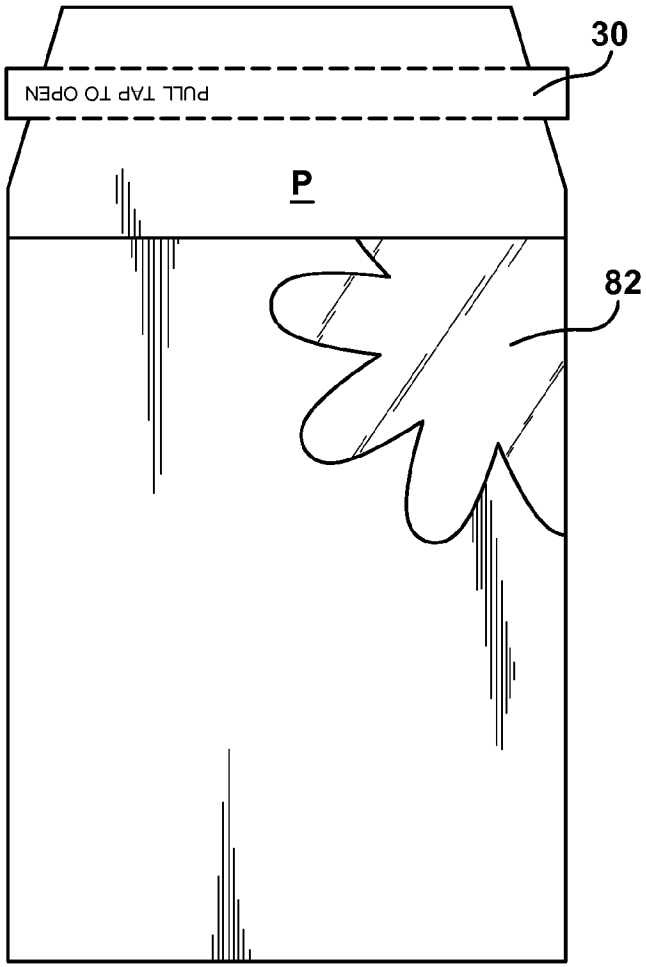
FIG. 10 is a fifth embodiment of the sound envelope of FIG. 1 wherein the envelope contains a cut-out or clear window through which a portion of the contents of the envelope is visible.

A fifth embodiment, shown in FIG. 10, is an audio envelope having a window through which artwork or other aspects of the contents of the envelope can be shown. The window may take any form and placement. The window may also be covered with a thin transparent material through which the contents are visible or the window may simple be a cut-out of the envelope. The sound mechanism would work as described in the preferred embodiment.

Figure 11:
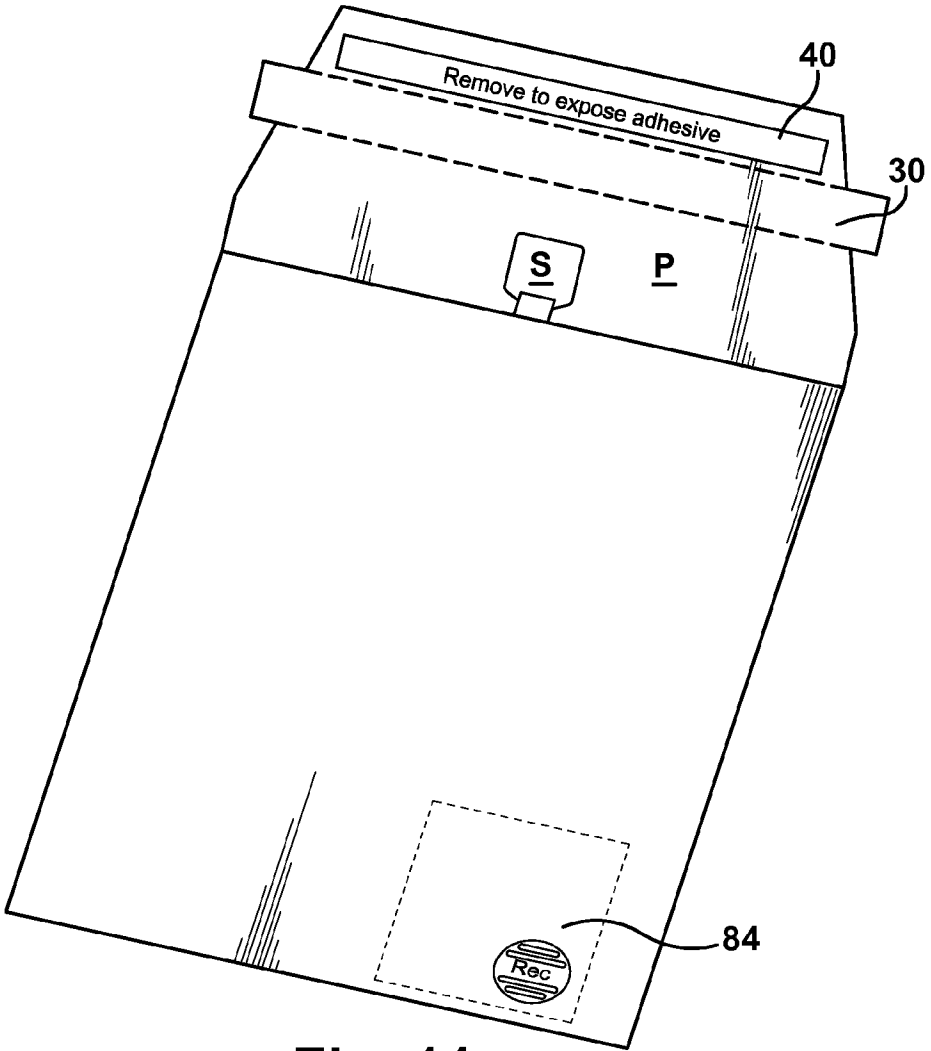
FIG. 11 is a sixth embodiment of the sound envelope of FIG. 1 containing a recordable sound mechanism.

A sixth embodiment is a recordable audio envelope, shown in FIG. 11. This embodiment would work much like the preferred embodiment but would additionally include a recording mechanism whereby the user can record a personal message to be played upon activation of the sound mechanism.

A seventh embodiment, is an envelope with removable sound mechanism by which a user may select a particular envelope, then select a particular sound clip and add it to the selected envelope. This allows the user to mix and match envelopes and sound clips.

Figure 12:
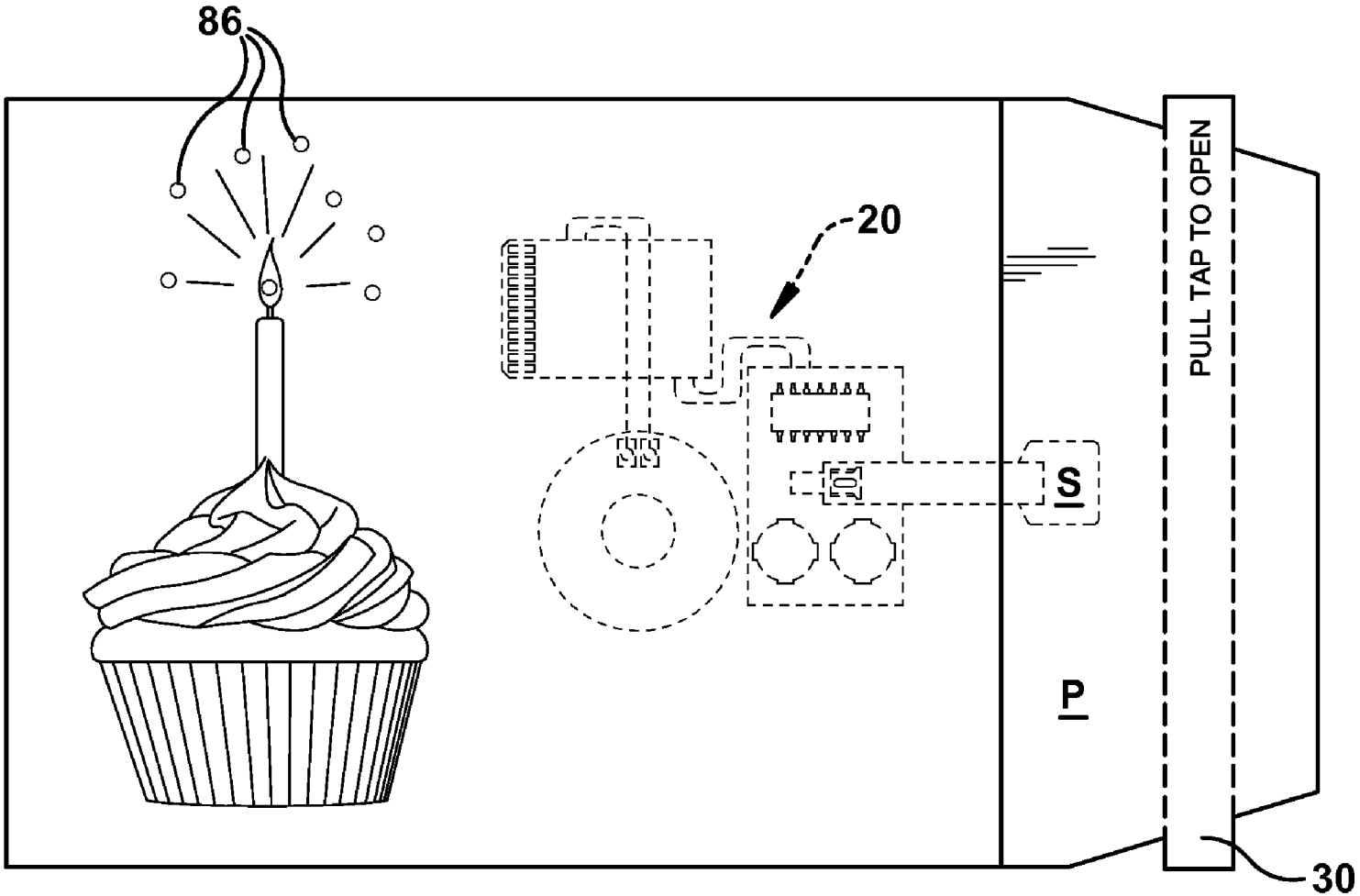
FIG. 12 is an eight embodiment of the sound envelope of FIG. 1 having a series of lights that are visible through the front of the envelope.

An eighth embodiment, shown in FIG. 12 provides an audio envelope that also activates lights upon opening. An additional power source is connected to a small standard light LED strand. The front of the envelope contains several openings through which the lights are visible.

Figure 13:
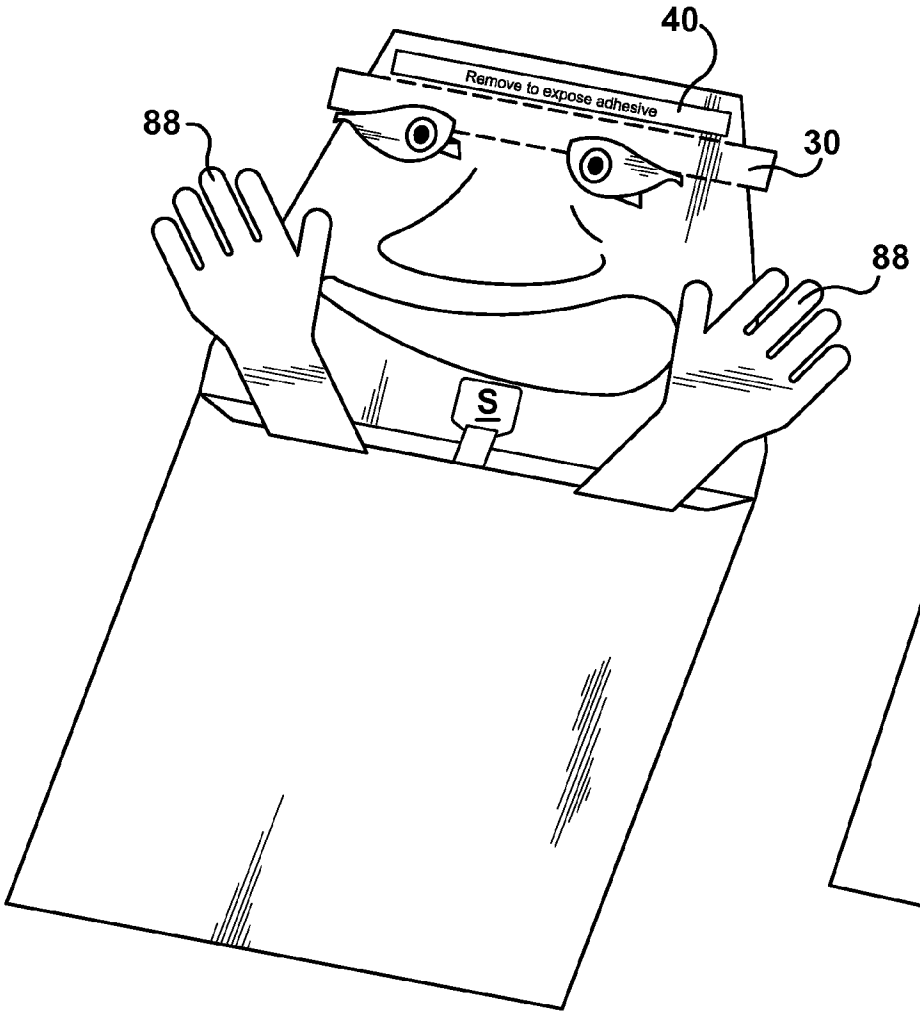
FIG. 13 is a ninth embodiment of the sound envelope of FIG. 1 having a pop up structure.

A ninth embodiment, shown in FIG. 13 provides a pop-out structure within the audio envelope. The pop out structure, which consists of a series of strategic fold lines, may be of any size, shape or form. The folded structure is placed beneath the flap so that when the flap is unfolded, the sound mechanism is activated and the pop up structure unfolds.

Figure 14:
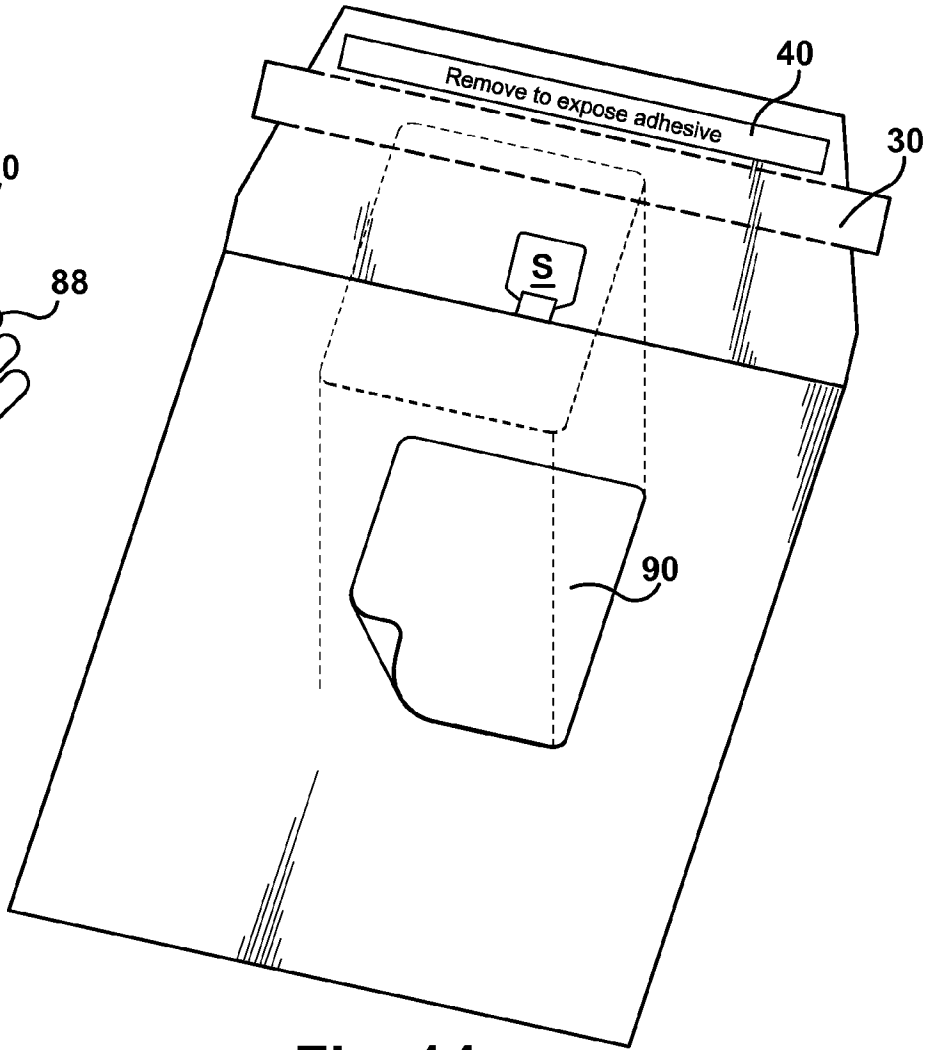
FIG. 14 is a tenth embodiment of the sound envelope of FIG. 1 having a removable address label.

A tenth embodiment, shown in FIG. 14, provides a reusable audio envelope. The portion of the envelope reserved for printing the recipients name and address is replaced by a removable sticker that can be easily removed and replaced with a new address sticker. The envelope closing mechanism consists of a reusable closing mechanism such as a snap, button, or other reusable closure mechanism.

An eleventh embodiment of the present invention creates a double-sound experience for the recipient. The envelope of the preferred embodiment, as shown in FIGS. 1-5, contains a sound-generating greeting card. When the recipient opens the envelope, a sound clip is activated. When the user removes and opens the greeting card, a second sound clip is activated. The greeting card would contain a sound module, as described in the present disclosure that contains a switch that lies across the center fold line of the greeting card so that when the card is opened along the fold line, the sound clip is triggered.

A twelfth embodiment includes personalizing the sound envelope of FIGS. 1-5 by adding a personal photograph or graphic to the outside surface of the sound envelope and/or adding a sound clip that is selected by the user. Personalization of this nature can be performed by purchasing the sound envelope from a web-site and uploading a photograph or other text graphics and a sound file with which the envelope will be customized.

The pre-recorded or user recorded digital sound content can be of any type and be coordinated with the design or theme or occasion of the envelope. Although specific embodiments of the audio envelope have been described herein, the sound module and trigger mechanism can be positioned in a variety of different configurations. The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. An audio envelope comprising:

a four-sided envelope having three closed sides forming a cavity therein and one open side for inserting and removing items therefrom, the cavity being operative to contain and conceal a greeting card or other generally planar or low profile article placed therein;

a flap connected to and integral with the four-sided envelope along a fold line, the flap having an envelope closing mechanism contained thereon operative to seal the one open side of the envelope thereby creating a closed cavity therein and an envelope opening mechanism located between the envelope closing mechanism and the fold line, a sound module fixedly attached to and concealed within the four-sided envelope, the sound module operative to store and playback at least one pre-recorded audio clip;

a switch mechanism located across the fold line;

whereby when the envelope is opened by the envelope opening mechanism and the flap is folded upwards along the fold line, the switch mechanism causes playback of the at least one pre-recorded audio clip.

2. The audio envelope of claim 1, wherein the envelope is lined with bubble wrap.

3. The audio envelope of claim 1, wherein the envelope contains a window through which a portion of the envelope contents is visible.

4. The audio envelope of claim 1 further comprising a recording mechanism for recording a personal message to be stored within the sound.

5. The audio envelope of claim 1 further comprising an LED light that is visible through the envelope.

6. The audio envelope of claim 1 further comprising a pop-up structure located beneath the flap.

7. The audio envelope of claim 1 further comprising a removable address sticker located on an outside front surface of the envelope.

8. The audio envelope of claim 1 further comprising a retail band over the envelope.

9. The audio envelope of claim 1, wherein the envelope is packaged in a clear sleeve.

10. The audio envelope of claim 1 further comprising a sound-generating greeting card that is complimentary to the audio envelope.

11. An audio envelope comprising:

a first panel, a second panel and a third panel, the first panel connected to the second panel along a first fold line and the second panel connected to the third panel along a second fold line;

a flap connected to and integral with the second panel along a third fold line, the flap having an envelope closing mechanism contained thereon operative to seal an open side of the envelope thereby creating a closed cavity therein and an envelope opening mechanism located between the envelope closing mechanism and the third fold line;

a sound module operative to store and playback at least one sound clip;

at least one slide switch mechanism located on the third fold line between the flap and the second panel; and wherein the first panel is folded over and attached to the second panel creating a first cavity within which the sound module is contained and concealed and the third panel is folded over and attached to the first panel creating a second cavity which is operative to store and conceal a greeting card or other low profile item, and whereby when the envelope is opened by the envelope opening mechanism and the flap is folded upwards along the fold line, the at least one slide switch mechanism causes playback of the at least one sound clip.

12. The audio envelope of claim 11 further comprising a recording mechanism.

13. The audio envelope of claim 11, wherein the digital storage medium is removable.

14. The audio envelope of claim 11 further comprising a removable address sticker.

15. The audio envelope of claim 11 further comprising a retail band over the envelope.

16. The audio envelope of claim 11, wherein the envelope is packaged in a clear sleeve.

17. An audio envelope comprising:

three rectangular main panels forming a closed cavity adjacent to an open cavity, the open cavity operative to contain a greeting card or other low profile item placed therein and removable therefrom;

a flap connected to and integral with one of the three rectangular main panels along a fold line, the flap having an envelope closing mechanism contained thereon operative to seal the open cavity and an envelope opening mechanism located between the envelope closing mechanism and the fold line;

a sound module contained within the closed cavity, the sound module operative to store and playback at least one digital audio file;

at least one switch mechanism located on the fold line;

whereby when the envelope is opened by the envelope opening mechanism and the flap is folded upwards along the fold line, the switch mechanism causes playback of the at least one pre-recorded audio clip.

18. The audio envelope of claim 17, wherein the envelope is lined with bubble wrap.

19. The audio envelope of claim 17, wherein the envelope contains a window through which a portion of the envelope content is visible.

20. The audio envelope of claim 17 further comprising a recording mechanism for recording a personal message.

21. The audio envelope of claim 17 further comprising a removable digital storage medium.

22. The audio envelope of claim 17 further comprising at least one LED light that is visible through the front of the envelope.

23. The audio envelope of claim 17 further comprising a pop-up structure located beneath the envelope flap.

24. The audio envelope of claim 17 further comprising a removable address sticker located on an outside front surface of the envelope.

25. The audio envelope of claim 17 further comprising a retail band over the envelope.

26. The audio envelope of claim 17, wherein the envelope is packaged in a clear sleeve.

27. The audio envelope of claim 17 further comprising a sound-generating greeting card that is complimentary to the audio envelope.

28. The audio envelope of claim 17, wherein the removable pull-tab has a length that is greater than the length of the flap.

* * * * *